US012721409B2

(12) United States Patent
Welling

(10) Patent No.: US 12,721,409 B2
(45) Date of Patent: Sep. 1, 2026

(54) BAG WITH OPENING MECHANISM

(71) Applicant: Jordan Welling, Portland, OR (US)

(72) Inventor: Jordan Welling, Portland, OR (US)

( * ) Notice: Subject to any disclaimer, the term of this patent is extended or adjusted under 35 U.S.C. 154(b) by 0 days.

(21) Appl. No.: 17/941,420

(22) Filed: Sep. 9, 2022

(65) Prior Publication Data

US 2023/0079466 A1 Mar. 16, 2023

Related U.S. Application Data

(60) Provisional application No. 63/242,964, filed on Sep. 10, 2021.

(51) Int. Cl.
*A45C 13/00* (2006.01)
*A45C 3/00* (2006.01)
(Continued)

(52) U.S. Cl.
CPC ..... *A45C 13/007* (2013.01); *A45C 3/00* (2013.01); *A45C 13/06* (2013.01); *A45C 13/103* (2013.01);
(Continued)

(58) Field of Classification Search
CPC ..... A45C 13/007; A45C 13/00; A45C 13/06; A45C 13/10; A45C 13/103;
(Continued)

(56) References Cited

U.S. PATENT DOCUMENTS 1,522,269 A * 1/1925 Recker ..... A45C 3/00 190/122
1,994,235 A 3/1935 Soloman
(Continued)

FOREIGN PATENT DOCUMENTS

CN 203762462 8/2014
EP 1201150 5/2002
(Continued)

OTHER PUBLICATIONS

Silas Bag, available at "https://silasltd.com/products/yellow-and-navy-facile-spring-frame-pouch", date unknown, author unknown.
(Continued)

*Primary Examiner* — Peter N Helvey

(57) ABSTRACT

A bag with an interior space and an opening includes an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged. Movement of the frame structure from the closed position to the open position causes the bag to open to allow access to the interior space. In one version. the frame structure comprises a front frame member pivotally connected to a rear frame member and wherein the biasing mechanism comprises a torsional spring that biases the front frame member to rotate away from the rear frame member.

13 Claims, 5 Drawing Sheets

(51) Int. Cl.
*A45C 13/06* (2006.01)
*A45C 13/10* (2006.01)
*A45C 13/12* (2006.01)

(52) U.S. Cl.
CPC ..... *A45C 13/1069* (2013.01); *A45C 13/1076* (2013.01); *A45C 13/123* (2013.01); *A45C 2013/1015* (2013.01)

(58) Field of Classification Search
CPC ..... A45C 13/1069; A45C 13/1076; A45C 13/123; A45C 3/00; A45C 2013/1015
USPC ..... 383/33
See application file for complete search history.

(56) References Cited

U.S. PATENT DOCUMENTS 2,142,764 A 1/1939 Kluger
2,158,955 A * 5/1939 Blacber ..... A45C 13/06 24/30.5 R
2,202,651 A * 5/1940 Freidman ..... A45C 3/00 150/123
2,390,673 A 12/1945 Wallace
2,764,327 A 9/1956 Stevenson
2,822,012 A 2/1958 Gold
3,326,258 A 6/1967 Stucker
3,445,359 A 5/1969 Sennewald et al.
3,584,756 A 6/1971 Gladwin
3,662,932 A 5/1972 Kerschner
3,960,300 A 6/1976 Dickler
3,995,802 A 12/1976 Johnston
4,392,598 A 7/1983 Dixon
4,609,084 A 9/1986 Thomas
4,810,102 A 3/1989 Norton
4,984,662 A 1/1991 Jacober
5,004,134 A 4/1991 Berry
5,016,792 A 5/1991 Jay
5,062,557 A 11/1991 Mahvi
5,117,883 A * 6/1992 Chen ..... A45C 13/103 383/14
5,135,144 A 8/1992 Blakey
5,205,448 A 4/1993 Kester
5,320,239 A 6/1994 Favre
5,344,037 A 9/1994 Favre
5,356,000 A 10/1994 Scicluna
5,447,261 A 9/1995 Mitomi
5,462,213 A 10/1995 Watt
5,560,483 A 10/1996 Sequin
5,609,419 A * 3/1997 Byers, Jr. ..... A45C 13/06 383/33
5,680,973 A 10/1997 Vulpitta
5,730,310 A 3/1998 Yoshihara
5,878,928 A 3/1999 Seiber
5,881,932 A 3/1999 Wadden
5,944,241 A 8/1999 Globig
5,964,470 A 10/1999 Syendsen
6,022,144 A * 2/2000 Hausslein ..... B65D 33/30 383/89
6,024,264 A 2/2000 Java
6,155,443 A 12/2000 Benedetti
6,161,665 A 12/2000 Hoover
6,161,739 A 12/2000 Bentzen
6,164,505 A 12/2000 Holter
6,179,186 B1 1/2001 Blanking
6,196,437 B1 3/2001 Smith, III
6,293,445 B1 9/2001 Miller
6,298,993 B1 10/2001 Kalozdi
6,371,642 B1 * 4/2002 Nelson ..... A47L 15/505 150/900
6,460,746 B1 10/2002 Amram
6,474,493 B1 11/2002 Lacout
6,837,346 B2 1/2005 Hollingsworth
6,899,460 B2 5/2005 Turvey
6,944,015 B1 9/2005 Jenkins
7,165,705 B2 1/2007 Haro
7,350,682 B2 4/2008 Meyer
7,665,642 B2 2/2010 Abbate
7,828,145 B2 11/2010 Grander
7,971,764 B2 7/2011 Sabbah
8,028,872 B2 10/2011 Hamlin
8,038,042 B2 10/2011 Bartel
8,201,837 B2 6/2012 Dweek
8,292,139 B2 10/2012 Golub
8,668,113 B2 3/2014 Hsu
8,818,464 B2 8/2014 Olsson
8,875,964 B1 11/2014 Vanderberg
D721,482 S 1/2015 Simmons
9,345,301 B2 5/2016 Brouard
9,499,291 B2 * 11/2016 Verma ..... B65D 33/2508
9,687,063 B2 6/2017 Paduano
9,689,524 B2 6/2017 Martin
10,045,596 B2 8/2018 Lundy
10,232,970 B2 * 3/2019 Verma ..... B65B 9/2056
10,244,850 B2 4/2019 Paduano
10,494,146 B2 * 12/2019 Verma ..... B65D 33/00
10,548,391 B2 2/2020 Setterfield
10,597,197 B2 * 3/2020 Verma ..... B65D 33/007
11,992,104 B2 * 5/2024 Sullivan ..... A45C 3/001
2004/0065708 A1 4/2004 Amram
2004/0188202 A1 9/2004 Chuang
2007/0012735 A1 1/2007 Lee
2007/0028429 A1 2/2007 Ishida
2007/0194543 A1 8/2007 Duvigneau
2008/0019618 A1 1/2008 Dayton et al.
2009/0071782 A1 3/2009 Rasmussen
2009/0145787 A1 6/2009 Grander
2010/0301078 A1 12/2010 Tamir
2011/0198374 A1 8/2011 Majeau
2016/0100672 A1 4/2016 Raske
2016/0200485 A1 7/2016 Quinones et al.
2018/0295960 A1 * 10/2018 Lee ..... A45C 13/1092
2019/0233121 A1 8/2019 Wunderlich et al.
2020/0172318 A1 * 6/2020 Dong ..... B65D 81/3897

FOREIGN PATENT DOCUMENTS

EP 2214794 8/2010
GB 613573 * 6/1946
GB 780862 * 8/1957
JP 2004129734 4/2004
JP 2010167182 8/2010
WO WO2005040990 5/2005
WO WO2009072981 6/2009
WO WO2012143521 10/2012

OTHER PUBLICATIONS

Husky Bag, available at Home Depot and at "https://www.homedepot.com/p/Husky-22-in-Spring-Loaded-Tool-Bag-1H-2220-SLO/315696332#overlay", date unknown, author unknown.
International Search Report and Written Opinion, PCT/US22/43107, Jan. 27, 2023.

* cited by examiner

BAG WITH OPENING MECHANISM

PRIORITY

The present application claims the benefit of domestic priority based on United States Provisional Patent Application 63/242,964 filed on Sep. 10, 2021, the entirety of which is incorporated herein by reference.

BACKGROUND

In today's world, bags are becoming increasingly ubiquitous. People carry all manner of items in their bags, and easy access can be of the utmost importance.

A typical bag can be made of flexible or rigid walls and typically has an open or openable top and a closed bottom. The bottom and side walls define a bag interior that can be used to store items. The open or openable top allows access to the interior. The bag can often have additional accessories, such as handles, straps, hooks, exterior pockets, and the like. Such bags have been in existence for centuries.

Unfortunately, the process of accessing the interior storage space of a bag to retrieve items therefrom and/or place items thereinto has heretofore not been ideal. In its simplest form, a bag may have a loose or floppy open top. A bag with a loose open top can be undesirable for several reasons. For example, the loose open top can be difficult to maintain in an open position. To place one or more items in the interior storage space, a user will often have to use one hand to keep the loose top open while the other hand is handling the items. In addition, a loose open top suffers from the disadvantage of not be easily securable in a closed position. This allows for the possibility of items spilling out of the bag. Sometimes a bag will be provided with a closure mechanism, such as a snap, latch, clip, Velcro, zipper, or the like. However, with conventional bags, the use of these closures can make the opening of the bag difficult or at least tedious. Often two hands and/or unnatural manipulations are needed to open the bag. This opening process can be even more challenging when additional items are being carried by the user or when the user's hands are being otherwise occupied.

Attempts have been made to overcome these deficiencies. For example, some diaper bags have been equipped with a pair of opposing U-shaped frame members that are connected to an openable top. In the open position, the frame members will maintain the top in an open position. However, these stay-open bags are not easy and convenient to open. The opening process requires multiple steps, one or more of which require two hands and/or difficult contortions. The first step is the unzipping of the bag, which itself generally requires two hands, but that still doesn't open the bag. A second step of physically pulling the sides of the bag or the sides of the opening apart is needed in order to move the opening to the open position. Two hands and/or the prying apart of the opening are necessary to perform this step. When a user is carrying a baby, this opening process can be very difficult without putting the baby down or holding the baby precariously. Another more sophisticated attempt to resolve the stay-open problem is a doctor's bag that includes an opening frame with a bi-stable or tri-stable mechanism that is stable and maintainable in a closed position and an open position and optionally in an intermediate position. However, this mechanism also requires the separation force be applied by a user to move the opening from the closed position to the open position.

Therefore, there is a need for a bag with an improved opening mechanism. There is a further need for a bag with an improved opening mechanism that can be maintained in an open position without manual manipulation. There is a further need for a bag with a self-opening mechanism that can move easily, conveniently, and/or automatically from a closed position to an open position.

SUMMARY

The present invention satisfies these needs. In one aspect of the invention, a bag with an improved opening mechanism is provided.

In another aspect of the invention, a bag comprises an improved opening mechanism that can be maintained in an open position.

In another aspect of the invention, a bag comprises an opening mechanism that can be easily opened and that at least partially self-opens and/or automatically opens.

In another aspect of the invention, a bag comprises an opening mechanism that can allow the bag to be opened with one hand.

In another aspect of the invention, a bag comprises an opening mechanism that can allow the bag to be opened with one hand and maintained in an open position on its own.

In another aspect of the invention, a bag comprises an opening mechanism that can latched in a closed position and that self-opens and/or automatically opens when unlatched.

In another aspect of the invention, a bag comprises an opening mechanism that is biased towards an open position and that is latchable in a closed position to overcome the bias.

In another aspect of the invention, a bag comprises an opening mechanism that is biased towards a fully open position and that is latchable in a closed position to overcome the bias.

In another aspect of the invention, a bag comprises an opening mechanism that is biased towards an open position and that is latchable in a closed position to overcome the bias, wherein the bias is applied until the bag is at least 50 percent open.

In another aspect of the invention, a bag comprises an opening mechanism that is biased towards an open position and that is latchable in a closed position to overcome the bias, wherein the bias is applied until the bag is at least 90 percent open.

In another aspect of the invention, a bag comprises an opening mechanism that is biased towards an open position and that is latchable in a closed position to overcome the bias, wherein the bias is applied until the bag is 100 percent open.

In another aspect of the invention, a bag comprises an opening mechanism that is biased towards an open position and that is latchable in a closed position to overcome the bias, wherein the bias generates an opening force when in the closed position and wherein the latch generates a latching force when the latch is engaged, the latching force being greater than the opening force.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space, wherein the frame structure comprises a front frame member and a rear frame member and wherein the biasing mechanism comprises a spring that biases the front frame member away from the rear frame member.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space, wherein the frame structure comprises a front frame member pivotally connected to a rear frame member and wherein the biasing mechanism comprises a torsional spring that biases the front frame member to rotate away from the rear frame member.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space, wherein the frame structure comprises a front frame member pivotally connected to a rear frame member, wherein the biasing mechanism comprises a torsional spring that biases the front frame member to rotate away from the rear frame member, and wherein the torsional spring biases the front frame member throughout the movement of the frame member from the closed position to the open position.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space, wherein the frame structure comprises a front frame member pivotally connected to a rear frame member, wherein the biasing mechanism comprises a torsional spring that biases the front frame member to rotate away from the rear frame member, wherein the torsional spring biases the front frame member throughout the movement of the frame member from the closed position to the open position, and wherein the open position corresponds to an angle of rotation of the front frame member relative to the rear frame member of from about 90 degrees to about 170 degrees.

In another aspect of the invention, a bag comprises a body having a sidewall, a bottom portion, and a top portion, wherein the sidewall and bottom portion define an interior space and wherein the top portion has an opening; and an opening mechanism comprising a frame structure in communication with the opening, a biasing mechanism adapted to apply a biasing force to the frame structure to move the frame structure from a closed position to an open position, and a latching mechanism adapted to latch the frame structure in the closed position when engaged and to allow the frame structure to move by the biasing force to the open position when disengaged, wherein movement of the frame structure from the closed position to the open position causes the bag to open to allow access to the interior space, wherein the latching mechanism comprises one or more magnets.

In another aspect of the invention, an opening mechanism for a bag having an opening, the opening mechanism comprises a frame structure adapted to communicate with the opening, wherein the frame structure comprises a front frame member pivotally connected to a rear frame member; and a biasing mechanism adapted to apply a biasing force to the frame structure to move the frame structure from a closed position to an open position, and wherein the biasing mechanism comprises a torsional spring that biases the front frame member to rotate away from the rear frame member; wherein the opening mechanism may be latched in the closed position by a latching mechanism when the latching mechanism is engaged and wherein the opening mechanism is allowed to move by the biasing force to the open position when the latching mechanism is disengaged.

In another aspect of the invention, a method of opening a bag, the method comprises providing a bag comprising a body having a sidewall, a bottom portion, and a top portion, wherein the sidewall and bottom portion define an interior space and wherein the top portion has an opening; disengaging a latching mechanism to cause an opening mechanism to open the opening by moving a frame structure from a closed position to an open position under a biasing force; and accessing the interior space through the opening.

In another aspect of the invention, a method of opening a bag, the method comprises providing a bag comprising a body having a sidewall, a bottom portion, and a top portion, wherein the sidewall and bottom portion define an interior space and wherein the top portion has an opening; disengaging a latching mechanism to cause an opening mechanism to open the opening by moving a frame structure from a closed position to an open position under a biasing force;

and accessing the interior space through the opening, wherein the latching mechanism is disengageble by a single hand of a user.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to bag. In particular, the invention relates to a bag with an at least partially automatic opening mechanism. Although the invention is illustrated and described in the context of a biased and latchable opening mechanism, the present invention can be made and/or used in other ways, as would be readily apparent to those of ordinary skill in the art. Accordingly, the present invention should not be limited just to the examples and embodiments described herein.

Figure 1A:
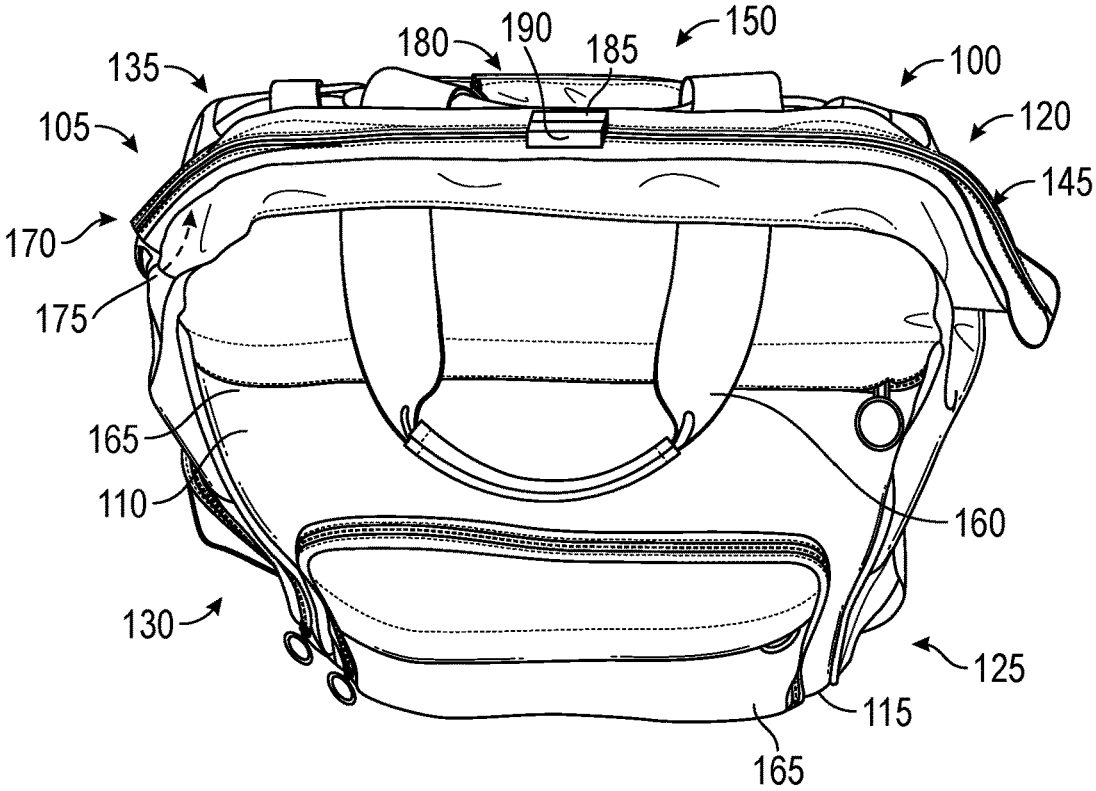
FIG. 1A is a schematic top-front perspective view of a bag according to the present invention in a closed position.
Figure 1B:
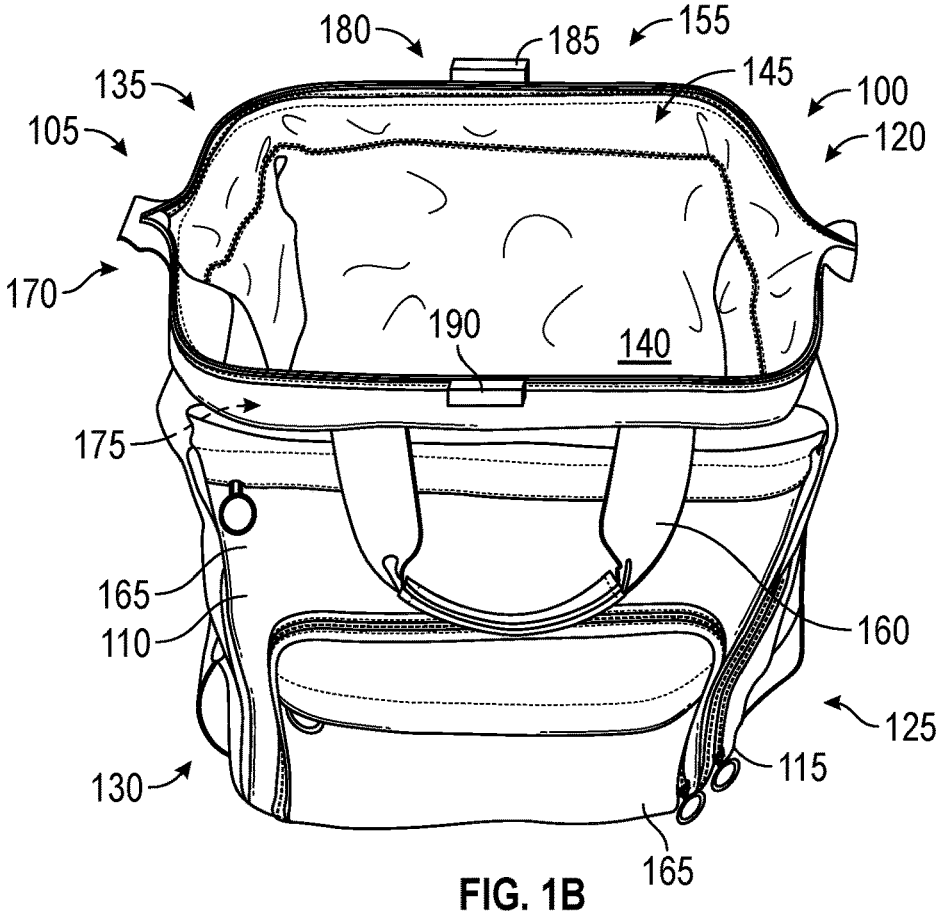
FIG. 1B is a schematic top-front perspective view of the bag of FIG. 1A in an open position.

FIGS. 1A and 1B show a bag 100 according to a version of the present invention. The bag 100 is made up of a body 105 that includes a sidewall 110 and a bottom 115. The bottom 115 can be a substantially flat wall or can be the sidewall 110 coming together to form a bottom. The bag 100 has a top portion 120, a bottom portion 125, a front side 130, and a rear side 135. The front side 130 and the read side 135 can be identical or can be different. The sidewall 110 and optionally the bottom 115 and optionally at least a portion of the top portion 120 create an interior space 140 within the bag 100 that can be used to store one or more items. Within the interior space 140 there can be but need not necessarily be additional pockets and/or compartments for segregated storage of items. The top portion 120 includes an opening 145 that can be selectively placed in a closed position 150, as shown in FIG. 1A, or in an open position 155, as shown in FIG. 1B. In the open position 155, the opening 145 allows for access to the interior space 140, and in the closed position 150, the opening 145 at least partially closes the access to the interior space 140. The bag can optionally contain additional features, such as a handle 160, one or more outer pockets 165, and/or a shoulder or carrying strap.

The top portion 120 of the bag 100 is equipped with an opening mechanism 170 that allows for improved and convenient access to the interior space 140 of the bag 100. The opening mechanism 170 directly or indirectly controls the opening 145 of the bag 100 and allows the opening 140 to the moved from the closed position 150 to the open position 155 automatically or partially automatically and/or at least partially under self-action. The opening mechanism 170 is made up of a frame structure 175 that controls the positioning of the opening 145 of the bag 100. In the version of FIGS. 1A and 1B, the frame structure 175 can be hidden from view by being placed between opposing pieces of fabric or other material that are part of the body 105 of the bag 100. The frame structure 175 is attached to the bag 100 in such a manner that movement of the frame structure causes movement of the opening 145 in the top portion 120 of the bag 100.

The frame structure 175 of the opening mechanism 170 is designed in such a way that it is biased towards the open position 155, as shown in FIG. 1B. Thus, when there is no external or additional force being applied, the bias of the opening mechanism 170 maintains the opening 145 of the bag 100 in the open position 145 of FIG. 1B. This opening mechanism 170 thus allows the bag 100 to be held in the open position 155 on its own to provide convenient access to the interior space 140 of the bag 100. This allows a user to place items into the interior space 140 and/or remove items from the interior space 140 without having to use one or more hands or having to perform inconvenient gesticulations to do so.

In one version, in addition to being designed to maintain the opening 145 in the open position 155, the opening mechanism 170 is designed to allow for improved, easier, and/or more convenient opening of the bag 100. In this version, the opening mechanism 170 includes a latching mechanism 180 that is designed to maintain the frame structure 175 and correspondingly the opening 145 in the closed position 150, as shown in FIG. 1A. When engaged, the latching mechanism 180 applies a holding force or latching force to the frame structure 175 that is greater than the biasing force that biases the frame structure 175 towards its open position 155. When disengaged, the latching mechanism 180 removes the latching force and/or reduces the latching force to a force that is less than the biasing force being applied to the frame structure 175 when in the closed position 150. Thus, when the latching mechanism 180 is disengaged, the frame structure 175 is allowed to move by action of the biasing force to the open position 155. In one version, the biasing force is applied throughout the movement of the opening mechanism 170 from the closed position 150 to the open position 155. To close the bag 100 or to move the bag 100 from its open position 155 to its closed position 150, a user can apply a force to physically move the frame structure 175 to its closed position 150 at which point the latching mechanism 180 can be engaged to maintain the bag 100 in the closed position 150.

The latching mechanism 180 can be any type of mechanism that is able to hold opposing sides of the opening 170 together with a force greater than the bias force that is acting to extend the frame structure 175 apart. In one version, the latching mechanism 180 includes a first member 185 on one side of the opening 170 that is latchingly engageable with a second member 190 on the other side of the opening 170. For example, the latching mechanism can be one or more snaps, hooks, clips, clasps, zippers, buttons, pins, hook and loop connectors such as Velcro, flaps, coin-purse type of latch, magnets, and the like. The engagement of the latching mechanism 180 can be either automatic or manually performed by the user.

In one particular version, the latching member 180 is a latching member that can be disengaged by a single hand and/or a single movement. By being disengageable by a single hand and/or by a single movement, a user can by using a single hand or making a single single movement cause the bag 100 to move from the closed position 150 to the open position 155. This is particularly advantageous when a user has one hand occupied and only a single hand free. For example, this version is particularly useful when the bag 100 is a diaper bag or other bag that is used to carry baby supplies. A user can carry a baby or holds hands with a child in one hand or arm and can use the other hand to access the contents of the bag 100 merely by disengaging the latching mechanism 180. Once disengaged, the frame structure 175 under operation of the bias will cause the bag 100 to self-open or automatically open to the open position 155, such as a fully open position, thereby allowing the user to reach into the interior space 140 and/or retrieve an item from the interior space 140. This version can also be useful with any other type of bag that is often used when one hand or arm is occupied.

Figure 2A:
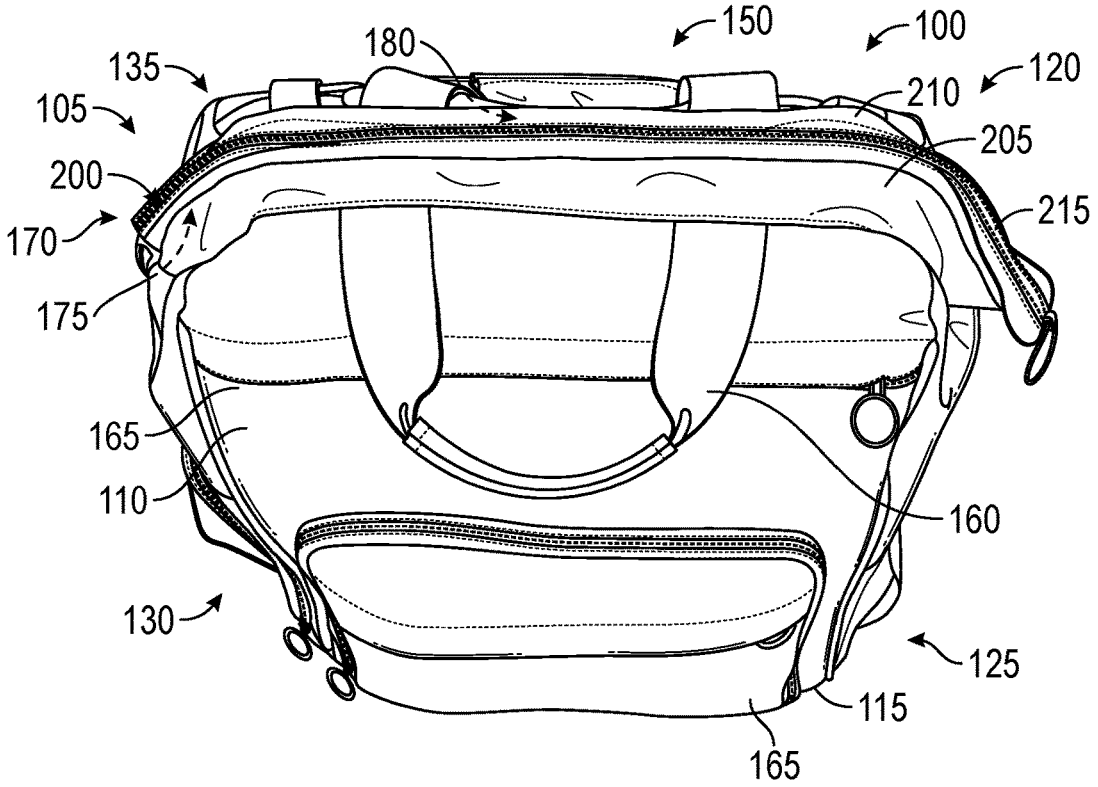
FIG. 2A is a schematic top-front perspective view of another version of a bag according to the present invention in a closed position.
Figure 2B:
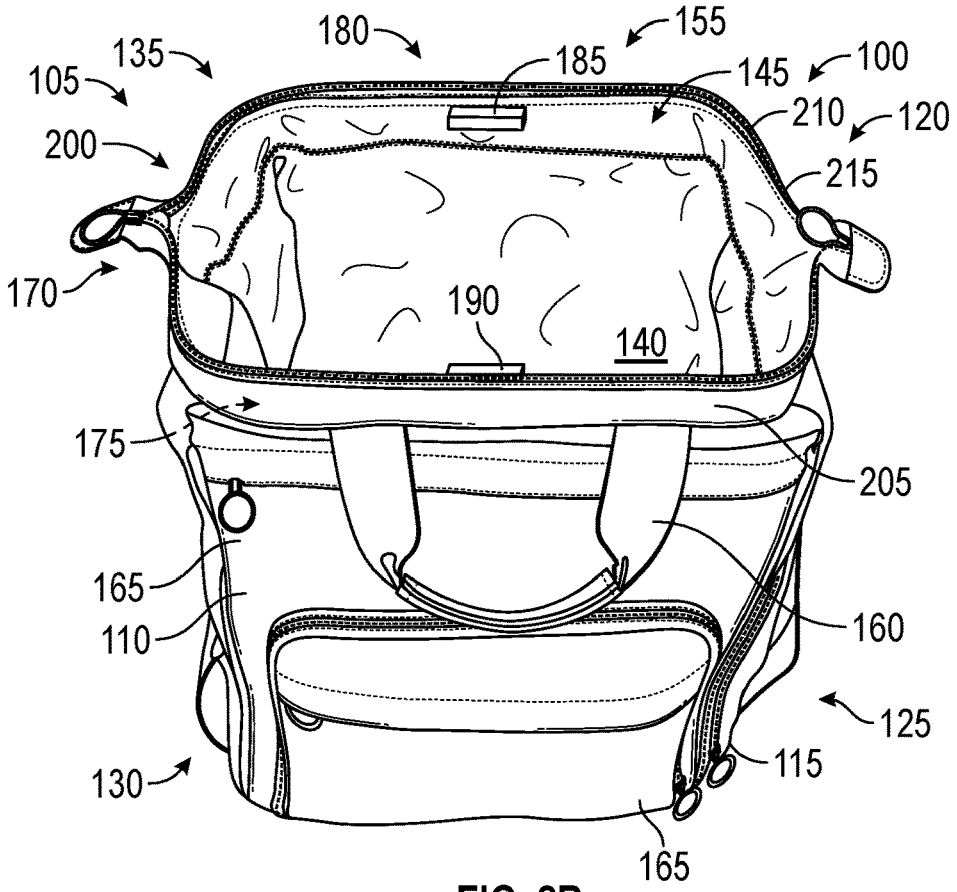
FIG. 2B is a schematic top-front perspective view of the bag of FIG. 2A in an open position.

Another version of a bag 100 of the invention is shown in FIGS. 2A and 2B. The version of FIGS. 2A and 2B is similar to the version of FIGS. 1A and 1B but with the addition of a secondary closure 200. The secondary closure 200 allows the opposing sides of the opening 145 to be more securely closed and/or connected to one another. In the version shown a piece of front side material 205 on the top 120 of the bag 100 is attachable to a piece of back side material 210 on the top 120 of the bag 100, such as by a zipper 215 or the like. To open the bag 100, the secondary closure 200 must first be unconnected and then the bag 100 can be opened in the manner discussed in connection with FIGS. 1A and 1B. The secondary closure 200 serves multiple purposes. First, it provides an additional layer of protection for the contents of the bag 100. In addition, when the secondary closure 200 is connected, the bag 100 cannot be fully opened by an accidental disengagement of the latching mechanism 180.

Figure 3A:
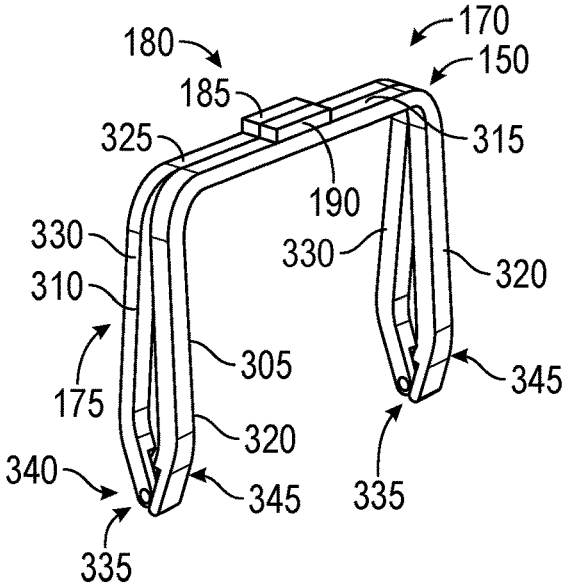
FIG. 3A is a schematic side perspective view of a version of an opening mechanism for a bag of the invention with the bag removed for clarity and with the opening mechanism in a closed position.
Figure 3B:
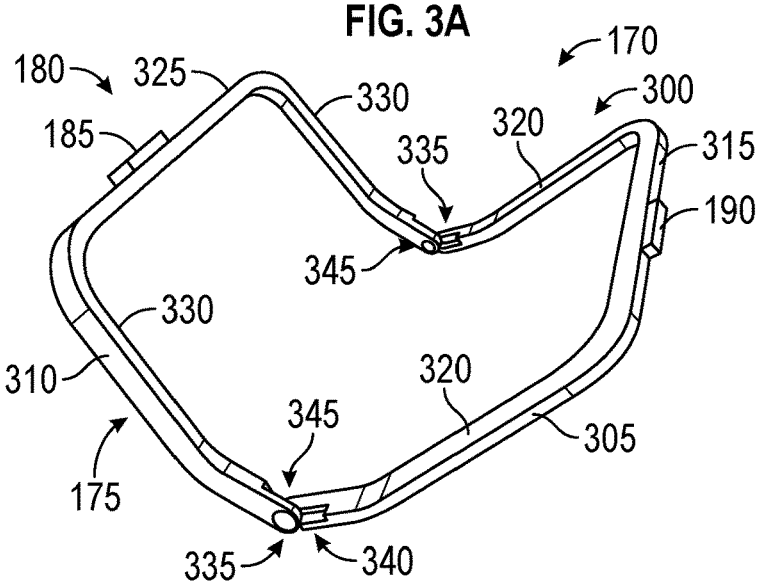
FIG. 3B is a schematic side perspective view of the version of an opening mechanism of FIG. 3A with the bag removed for clarity and with the opening mechanism being shown during an opening process.
Figure 3C:
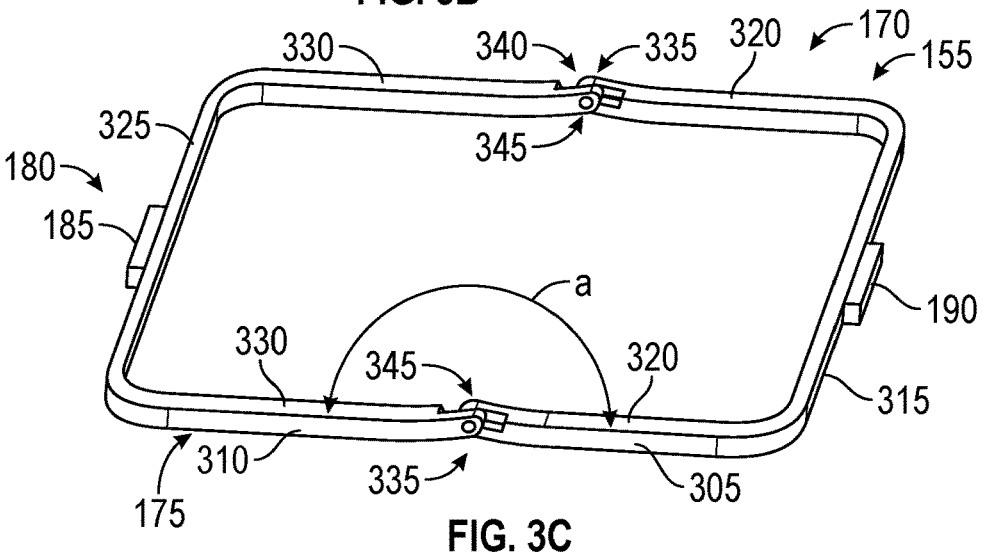
FIG. 3C is a schematic side perspective view of the version of an opening mechanism of FIG. 3A with the bag removed for clarity and with the opening mechanism in a fully open position.

FIGS. 3A, 3B, and 3C illustrate the operation of a version of the opening mechanism 170 than can be used with any version of the bag 100 of the invention. FIG. 3A shows the opening mechanism in a closed position 150. FIG. 3C shows the opening mechanism 170 in an open position 155. FIG. 3B shows the opening mechanism 170 at an intermediate position 300 as it moves from the closed position 150 to the open position 155 or from the open position 155 to the closed position 150. In this version, the frame member is made up of a front frame member 305 and a rear frame member 310 that are pivotally connected to one another. The front frame member 305 in the version shown is a generally U-shaped structure having a front bar 315 and a pair of legs 320 extending from the ends of the front bar 315. The rear frame member 310 in the version shown includes a rear bar 325 and a pair of legs 330 extending from the ends of the rear bar 320. The front frame member legs 320 and the rear frame member legs 330 are connected to each other at one or more hinges 335. In another version, the frame members can be generally L-shaped and can meet at a single hinge 335. In this particular version, the front bar 315 and the rear bar 325 are generally parallel to one another and stay generally parallel to one another when the front frame member 305 and the rear frame member 310 pivot or rotate relative to one another. Alternatively, the front bar 315 and/or the back bar 325 can be other than parallel and can be in a shape other than the straight shape shown in FIGS. 3A, 3B, and 3C.

The front frame member 305 and the rear frame member 310 of the opening mechanism 170 are biased away from one another by a biasing mechanism 340. In one version, the biasing mechanism 340 is made up of one or more torsional biasing mechanisms 345 at the one or more hinges 335. The torsional biasing mechanism 345, such as a torsion spring, places a torsional force on the hinge that biases the front frame member 305 and the rear frame member 310 to move or rotate away from one another. Under unrestrained action of the torsional biasing mechanism 345, the front frame member 305 and rear frame member 310 will rotate apart to the open position 155 shown in FIG. 3C where the front frame member 305 and the rear frame member 310 form the mouth of the opening 145. FIG. 3A shows the opening mechanism in the closed position 150 with the latching mechanism 180 in an engaged position where sufficient force is applied to counter the torsional bias from the biasing mechanism 340. When the latching mechanism 180 is disengaged, the biasing mechanism 340 will start to move the opening mechanism through the position shown in FIG. 3B to the open position 155 of FIG. 3C. To close the opening mechanism 170, physical force is applied to move the front frame member 305 towards the rear frame member 310 against the bias force until the latching mechanism can be engaged. For example, a user can apply a force with one hand on the front frame member 305 and with another hand on the rear frame member 310 to cause the two frame members to come together. Alternatively, a user can have the rear frame member rest against a body part such as a hip and the user can use a hand on the front frame member 310 to pull it towards the body part, or a user can have the bag 100 rest on the ground on its side and can then press down on one of the frame members to close the bag 100. In an alternative version, the torsional spring can be replaced with a linear spring that biases the front frame member 305 away from the rear frame member 310.

Though the body 105 of the bag 100 is not shown for clarity in FIGS. 3A, 3B, and 3C, it will be understood that the opening mechanism 170 of FIGS. 3A, 3B, and 3C is insertable on or within the bag 100 at the top portion 120 of the bag 100 in a manner where the front frame member 305 is associated with one side of the opening 140 of the bag 100 and the rear frame member 310 is associated with an opposing side of the opening 140 of the bag 100. Movement of the front frame member 305 will thus cause corresponding movement of its associated side of the opening 140, and movement of the rear frame member 310 will cause corresponding movement of its associated side of the opening 140. To accomplish this, the opening mechanism 170 can be stitched, glued, or otherwise attached to the material of the top 120 of the bag 100. The opening mechanism 170 can be on an inner surface of the bag 100, on an outer surface of the bag 100, or can be between an inner layer of material and an outer layer of material. The latching mechanism 180 can be located on the front frame member 305 and the rear frame member 310 directly or can be provided on the material of the bag 100 at or near the opening 145.

In one version, the biasing force from the biasing mechanism 340 biases the frame structure 175 towards the open position 155 and the biasing force remains, as either a constant or a gradually decreasing force, until the opening mechanism 170 reaches the open position 155. In the version of FIG. 3C, the open position 155 is a fully open position. By fully open position it is meant that the biasing mechanism 340 applies a biasing force until the opening mechanism 170 is open to at least 90 percent of the maximal extent of the opening, as measured in terms of each area of the opening or the largest distance from one side to the opposite side or the like. In one version, the open position is 100 percent of the maximal extent of the opening. In this version, at least a small biasing force can remain in action at the open position 155 to help maintain the bag in the open position 155. In another version, the open position 155 can be a position that is short of the fully open position. For example, the open position 155 can be a position that is at least about 50 percent or at least about 70 percent of the maximal extent of the opening. With these versions where the opening position 155 is less than the fully open position, the opening mechanism 170 can be used to initially open the bag 100 to the open position 155 and then the user can have the option of using the bag 100 in the open position 155 or manually opening the bag to its fully open position.

As also can be seen in the version of FIGS. 3A, 3B, and 3C, the open position 155 is associated with a complete or near complete pivoting of the front frame member 305 relative to the rear frame member 310. In the particular version shown, the angle of rotation, a, of the front frame member 305 relative to the rear frame member 310 about the hinge 335 by about 180 degrees, as defined by either the relative angle of the front frame member legs 320 to the rear frame member legs 330 or a line drawn from the front bar 315 to the hinge 335 as compared to a line drawn from the rear bar 325 to the hinge 335. In another version, the angle of rotation, a, at the open position 155 can be more or less than 180 degrees. For example, depending on the length of the legs 320,330 and how deeply into the bag 100 the hinge 335 extends, the angle of rotation, a, can be much less than 180 degrees. In such case, the open position 155 may more closely approximate the position shown in FIG. 3B. In another example, it may be desirable to more securely open the bag by having the angle of rotation, a, be greater than 180 degrees. Accordingly, the angle of rotation, a, can range from about 45 degrees to about 225 degrees. In one particular version, the angle of rotation, a, is less than about 170 degrees, or from about 90 degrees to about 170 degrees, or from about 150 degrees to about 170 degrees, or about 165 degrees. This particular version is designed to make the bag 100 easier to close since the hinge 335 is already rotated when the closing process begins.

Figure 4A:
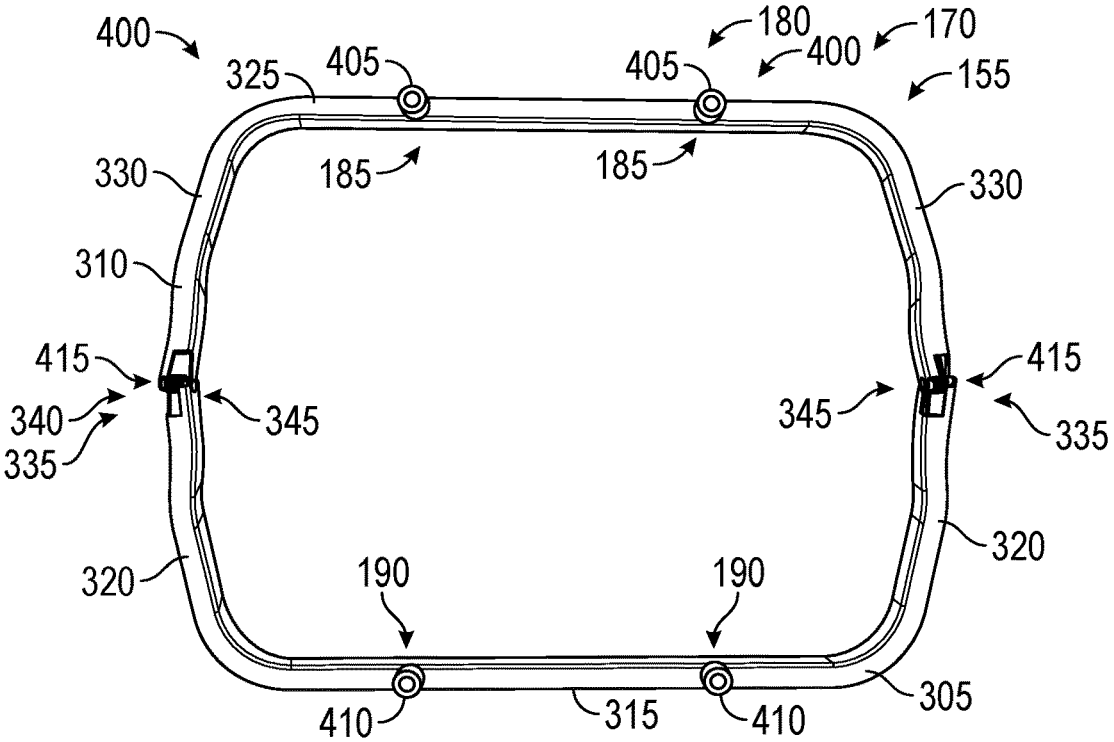
FIG. 4A is a schematic top view of another version of an opening mechanism for a bag of the invention with the bag removed for clarity and with the opening mechanism in a fully open position.

FIG. 4A shows a top view of a particular version of an opening mechanism 170 in its open position 155. In this version, the latching mechanism 180 is made of one or more magnetic latches 400. Each magnetic latch 400 is made up of a magnet 405 positioned on the front frame member 305 and a corresponding attraction member 410 on the rear frame member 310. The attraction member 410 can be a material the magnet 405 is attracted to or can be a magnet of opposite polarity of the magnet 405. The force of attraction between the magnet 405 and the attraction member 410 creates a net latching force that is greater than the net biasing force and thus is strong enough to prevent the biasing mechanism 340 from moving the front frame member 305 away from the rear frame member 310 when the magnet 405 and the attraction member 410 are engaged by touching or by being in close proximity to one another. To disengage the magnetic latch 400, a user applies a force to cause the front frame member 305 to move away from the rear frame member 310 a small but sufficient amount so that the attraction force between the magnet 405 and the attraction surface 410 becomes smaller than the biasing force from the biasing mechanism 340. Once the magnetic latch 400 is disengaged, the opening mechanism will spring open automatically to the open position 155. The opening mechanism 170 can then be closed by moving the front frame member 305 close enough to the rear frame member 310 that the magnet latch 400 engages. In the particular version shown in FIG. 4A, two magnetic latches 400 are provided. Other versions may have one, three, four, five, or any other number of magnetic latches 400.

To open a bag 100 having one or more magnetic latches 400 of the type shown in FIG. 4A, a user can with a single hand or even single finger cause enough separation of the opening mechanism 170 to disengage the magnetic latch 400 and cause the bag 100 to self-open and maintain itself in the open position 155. This can also be accomplished by inserting a small object or finger between the front frame member 305 and the rear frame member 310 and wedging them apart. In addition, the opening mechanism 170 of the bag 100 can be opened without even touch the opening mechanism 170 by applying a quick jerk on the bag that will by inertia and momentum cause the front frame member 305 to separate enough from the rear frame member 310 to cause disengagement of the one or more magnetic latches 400. The one or magnetic latches 400 could also be designed so that they open under the force of gravity, such as by provided a weighted front frame member 310 that when tilted at the right angle will by the force of gravity produce a strong enough force to disengage the one or more magnetic latches 400.

The strength of the biasing mechanism 340 and the strength of the latching mechanism 180 are designed in connection with one another. The biasing mechanism is sufficiently strong to cause the front frame member 305 to automatically and without assistance move away from the rear frame member 310 to the open position 155 but not so strong that the opening process is so strong that it could cause injury. The latching mechanism 180 is sufficiently strong to overcome the force of the biasing mechanism 340 but not so strong that it because difficult to disengage the latching mechanism 180. The exact forces themselves can vary due to the size of the bag 100 or opening 145, the materials used, and the purposes of the bag 100. In one version, the biasing mechanism 340 generates a net biasing force when the opening mechanism 170 is in the closed position of from about 0.1 N to about 100 N, or from about 1 N to about 10 N, and in one particular version is about 1.7 N. This biasing force can weaken during opening to a lesser force, and in one particular version is about 0.5 N in the open position 155. Alternatively, the force can be weakened to less and even to zero at the open position 155, but the maintaining of a small amount of force helps to maintain the opening mechanism 170 in the open position 155.

Figure 4B:
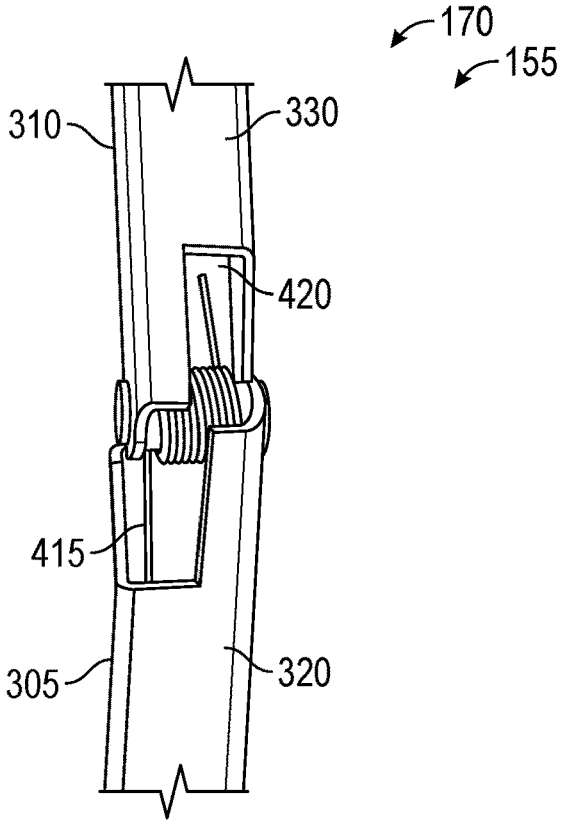
FIG. 4B is a schematic top view of a close up view of a version of a biasing mechanism for the version of FIG. 4A.

FIG. 4B shows a close-up viewed of an example of a coil torsional spring 415 that can be used as the torsional biasing mechanism 345 of the biasing mechanism 340. In this particular version designed for a diaper bag, the coil torsional spring has a coil made of carbon steel with a galvanized surface. As can also be seen in FIG. 4B, the legs 320,330 can include a hollowed portion 420 adapted to contain the coil torsional spring 415. Optionally, the hollowed portion 420 can extend throughout the legs 320,330 and/or the bars 315,325 to reduce the weight of the frame structure 175. The wire of the coil has a diameter of about 0.75 mm and the coil has about 9 coils and an outer diameter of about 7.0 mm. The legs of the wire extending from the coil are about 70 degrees apart with a leg length of about 25 mm. The coil torsional spring 415 of this version has a spring rate of from about 0.1 N-mm/degrees to about 1.0 N-mm/degrees, and in one particular version has a spring rate of 0.34 N-mm/degrees, it being noted that the net biasing force being generated in this version comes from two coil torsion springs 415 at each of two hinges 335 and that if a single hinge and/or coil torsion spring 415 is used, the strength would be changed accordingly to result in the same net biasing force. With this particular version, of FIGS. 4A and 4B, the coil torsional springs 415 generate a net biasing force when the opening mechanism 170 is in the closed position 150 of torque from about 1 N-mm to about 5000 N-mm, or from about 100 N-mm to about 500 N-mm, and in one particular version is about 187 N-mm. Also with this particular version the coil torsional springs 415 generate a net biasing force when the opening mechanism 170 is in the open position 155 of torque from about 0 N-mm to about 1000 N-mm, or from about 15 N-mm to about 100 N-mm, and in one particular version is about 37 N-mm.

The strength of the latching mechanism 180 depends on the strength of the biasing mechanism 340 and on the intended purpose of the bag 100. In one version, the net force of the latching mechanism 180 is at least 110 percent or at least 150 percent or at least two times or 200 percent of the net strength of the biasing force. In one version the net latching force is from about 1.5 times to about 500 times, or from about 2 times to about 100 times, or from about 30 times to about 50 times the net biasing force. In one version, for a biasing force of from about 0.1 N to about 100 N in the closed position 150, the latching force can range from about 5 N to about 500 N with the latching force being at least two times the biasing force. In one version, for a biasing force of from about 1 N to about 10 N in the closed position 150, the latching force can range from about 25 N to about 250 N with the latching force being at least two times the biasing force. In the particular version of FIGS. 4A and 4B, the version has a 1.7 N net biasing force combined with a 65 N net latching force produced by the combination of magnetic latches 400. The strength of the particular magnets 405 will depend on the number used and the amount of material between the magnet 405 and the attraction member 410.

Figure 5:
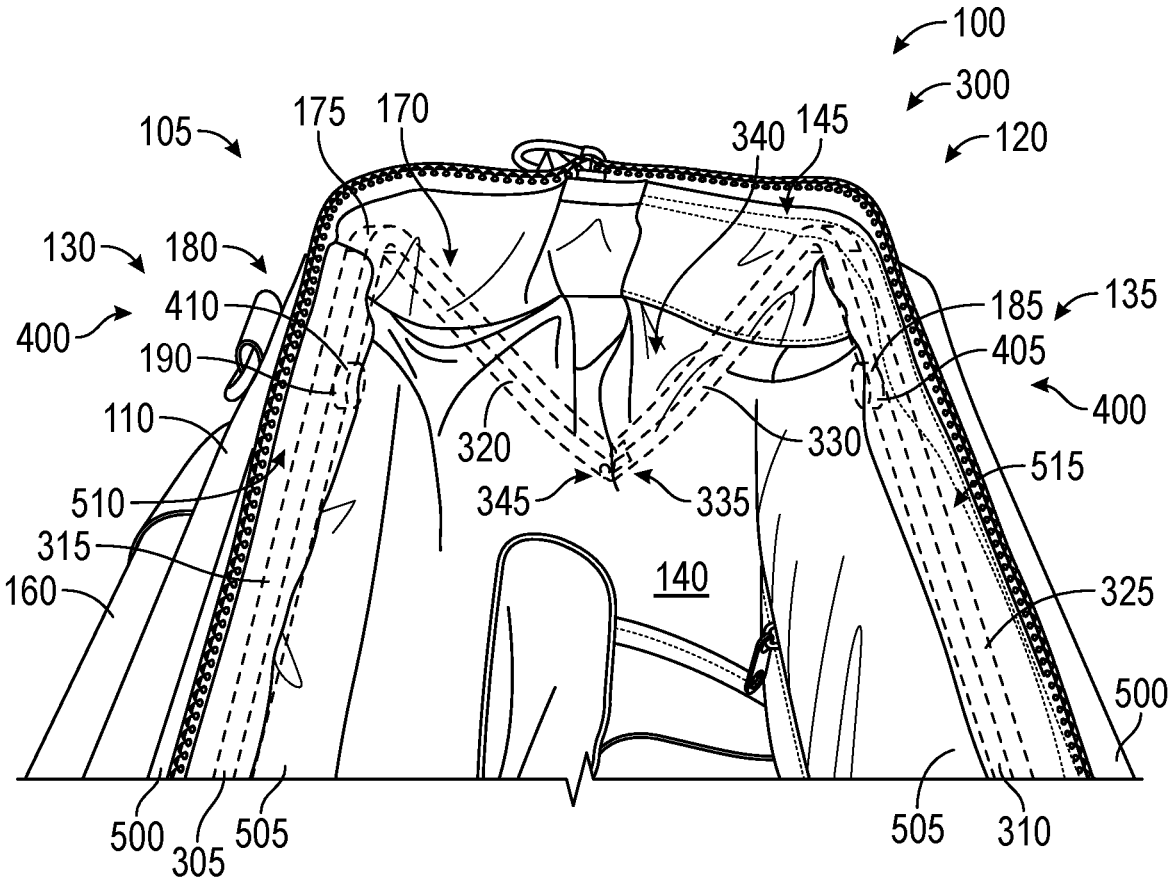
FIG. 5 is a schematic top-side perspective view of a version of a bag of the invention with the bag in a fully open position.

FIG. 5 shows another version of a bag 100 of the invention. In this version, the opening mechanism 170 is sewn between an inner material and an outer material of the bag 100. As shown, the opening mechanism 170 is sewn into the bag 100 between an outer layer of material 500 and an inner layer of material 505. In one version, the opening mechanism 170 is sewn into the bag 100 only at a front top region 510 that is associated with the front bar 315 and in a rear top region 515 that is associated with the rear bar 325. In this version, the legs 320,330 and the hinges 335 are not sewn and are free floating between the outer layer 500 and the inner layer 510. This allows the hinges 335 to rotate freely without much resistance from the material of the bag 100.

The bag 100 and the opening mechanism 170 can be made of any materials suitable for their purpose. For example, the bag can be made of one or more of polyester, cotton, nylon, wool, leather, polyurethane, and the like and can be in any size or shape. The opening mechanism can be made of one or more of metal, plastic, wood, and any solid material that can hold a shape and can be in any size, shape, or configuration. The bag 100 can take the form of any type of bag useful for carry any item. While shown here in the form of a diaper bag, the bag could alternatively be any other bag, such as a backpack, tote bag, duffle bag, tool bag, medial bag, purse, and the like.

In another version, the biasing mechanism 340 can be replaced by a gravity operated system where gravity and the weight of the frame structure 175 serve as the force use to open the bag 100 from the closed position 150 to the open position 155. In this version, the front bar 305 can be sufficiently weighted so that when the bag 100 is tilted, the weight of the front bar 305 under the force of gravity overcomes the latching mechanism 180 and causes the bag 100 to open.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A bag comprising:

a body having a sidewall, a bottom portion, and a top portion, wherein the sidewall and bottom portion define an interior space and wherein the top portion has an opening; and an opening mechanism comprising a frame structure in communication with the opening, the frame structure comprising a front frame member and a rear frame member, a biasing mechanism adapted to apply a biasing force to the frame structure to move the frame structure from a closed position to an open position, wherein the biasing mechanism comprises a spring that biases the front frame member away from the rear frame member, and a latching mechanism adapted to latch the frame structure in the closed position when engaged and to allow the frame structure to move by the biasing force to the open position when disengaged, wherein the latching mechanism comprises a magnetic latch, wherein the magnetic latch has a latching force that is greater than the biasing force by the biasing mechanism when engaged, and wherein the magnetic latch has a latching force less than the biasing force when disengaged, wherein movement of the front frame member away from the rear frame member causes the latching mechanism to disengage so that the biasing mechanism can cause the bag to move to the open position to allow access to the interior space, and wherein the biasing force continues to apply a biasing force to the frame structure when the frame structure is in the open position.

2. A bag according to claim 1 wherein the front frame member is pivotally connected to the rear frame member and wherein the biasing mechanism comprises a torsional spring that biases the front frame member to rotate away from the rear frame member.

3. A bag according to claim 1 wherein the front frame member is pivotally connected to the rear frame member, wherein the biasing mechanism comprises a torsional spring that biases the front frame member to rotate away from the rear frame member, and wherein the torsional spring biases the front frame member throughout the movement of the frame member from the closed position to the open position.

4. A bag according to claim 1 wherein the front frame member is pivotally connected to the rear frame member, wherein the biasing mechanism comprises a torsional spring that biases the front frame member to rotate away from the rear frame member, wherein the torsional spring biases the front frame member throughout the movement of the frame member from the closed position to the open position, and wherein the open position is a fully open position.

5. A bag according to claim 1 wherein the front frame member is pivotally connected to the rear frame member, wherein the biasing mechanism comprises a torsional spring that biases the front frame member to rotate away from the rear frame member, wherein the torsional spring biases the front frame member throughout the movement of the frame member from the closed position to the open position, and wherein the open position is a position that is 100 percent of the maximal extent of the opening.

6. A bag according to claim 1 wherein the front frame member is pivotally connected to the rear frame member, wherein the biasing mechanism comprises a torsional spring that biases the front frame member to rotate away from the rear frame member, wherein the torsional spring biases the front frame member throughout the movement of the frame member from the closed position to the open position, and wherein the open position corresponds to an angle of rotation of the front frame member relative to the rear frame member of from about 45 degrees to about 225 degrees.

7. A bag according to claim 1 wherein the front frame member is pivotally connected to the rear frame member, wherein the biasing mechanism comprises a torsional spring that biases the front frame member to rotate away from the rear frame member, wherein the torsional spring biases the front frame member throughout the movement of the frame member from the closed position to the open position, and wherein the open position corresponds to an angle of rotation of the front frame member relative to the rear frame member of from about 90 degrees to about 170 degrees.

8. A bag according to claim 1 wherein the front frame member is pivotally connected to the rear frame member, wherein the biasing mechanism comprises a torsional spring that biases the front frame member to rotate away from the rear frame member, wherein the torsional spring biases the front frame member throughout the movement of the frame member from the closed position to the open position, wherein the open position is a position that is 100 percent of the maximal extent of the opening, and wherein the open position corresponds to an angle of rotation of the front frame member relative to the rear frame member of less than 170 degrees.

9. A bag according to claim 1 wherein the front frame member is pivotally connected to the rear frame member, wherein the biasing mechanism comprises a torsional spring that biases the front frame member to rotate away from the rear frame member, and wherein the latching mechanism comprises one or more magnets adapted to attract the front frame member to the rear frame member in the closed position with sufficient attraction force to prevent the biasing mechanism from moving the frame structure to the open position.

10. A bag according to claim 1 wherein the front frame member is pivotally connected to the rear frame member by one or more hinges, and wherein the one or more hinges moves relative to the sidewall during movement of the frame structure from the closed position to the open position.

11. A bag according to claim 10 wherein the one or more hinges is free floating between an outer layer and an inner layer of the sidewall.

12. A bag according to claim 10 wherein the biasing mechanism comprises a torsional spring that biases the front frame member to rotate away from the rear frame member, wherein the torsional spring biases the front frame member throughout the movement of the frame member from the closed position to the open position, wherein the open position is a position that is 100 percent of the maximal extent of the opening, and wherein the open position corresponds to an angle of rotation of the front frame member relative to the rear frame member of less than 170 degrees.

13. A bag according to claim 10 wherein the biasing mechanism comprises a torsional spring that biases the front frame member to rotate away from the rear frame member, wherein the torsional spring biases the front frame member throughout the movement of the frame member from the closed position to the open position, and wherein the open position is a position that is at least 50 percent of the maximal extent of the opening.

* * * * *